United States Patent [19]

Groseclose

[11] 3,966,286

[45] June 29, 1976

[54] BLOOD-SPECIMEN PROCUREMENT CART

[76] Inventor: Pauline Inez Groseclose, 611 E. Bonds St., Carson, Calif. 90745

[22] Filed: Oct. 31, 1975

[21] Appl. No.: 627,539

[52] U.S. Cl. ..... 312/258; 312/250; 312/209; 312/262

[51] Int. Cl.[2] ..... A47B 43/00

[58] Field of Search ..... 312/258, 250, 262, 264, 312/324, 327, 209

[56] References Cited

UNITED STATES PATENTS

| | | | |
|---|---|---|---|
| 2,575,661 | 11/1951 | Hickey | 312/250 |
| 3,087,767 | 4/1963 | Schell | 312/250 |
| 3,695,746 | 10/1972 | Youngblood | 312/258 |

*Primary Examiner*—Paul R. Gilliam
*Assistant Examiner*—Victor N. Sakran
*Attorney, Agent, or Firm*—Ralph B. Pastoriza

[57] ABSTRACT

A cart on rollers includes a rigid cabinet portion and a foldable cabinet portion permitting the cart to be folded into a volume of less than half its normal size. The cart includes trays, shelves, and compartments for holding medical supplies used in taking blood-specimens in hospitals.

10 Claims, 6 Drawing Figures

BLOOD-SPECIMEN PROCUREMENT CART

This invention relates to carts and more particularly to a portable blood-specimen procurement cart for use in hospitals.

BACKGROUND OF THE INVENTION

It is common practice in hospitals for venipuncturists to make rounds throughout the day to collect blood-specimens from various patients. In such operations, various pieces of medical equipment and other miscellaneous supplies are necessary; for example, appropriate supplies of needles, syringes, specimen tubes of varying sizes, and so forth. Normally, a fixed cart structure on rollers is used by the venipuncturists to carry these various supplies but such carts as are available have not been designed for maximum efficiency.

A fixed or rigid cart structure has the advantage of stability but presents a storage problem when not in use. Foldable cart structures, on the other hand, are not always reliable from a stability standpoint. Any inadvertent movement of one of the folding portions could cause upset of the cart and splattering of the various medical supplies.

In addition to the foregoing, any type of mobile or portable cart structure to aid a person in taking blood-specimens should include appropriate compartments, shelves, and the like to enable efficient organization of the various supplies.

BRIEF DESCRIPTION OF THE PRESENT INVENTION

With the foregoing considerations in mind, the present invention contemplates a vastly improved foldable cart structure particularly designed for the procurement of blood-specimens wherein various problems as outlined above are overcome.

More particularly, the cart of the present invention is so designed as to be foldable into a compact configuration when not in use and yet present an extremely stable and reliable construction when in unfolded position. Further, appropriate shelves and compartments are provided in such a manner as to enable efficient organization of materials and supplies utilized in the procurement of blood specimens.

Briefly, the cart includes a rigid cabinet portion including a vertical rear panel, left and right rigid side panels secured to and extending forward from the rear panel, and front cabinet doors hinged to the forward vertical edges of the rigid side panels. A folding cabinet portion in turn includes left and right foldable side panels hinged to and extending rearwardly from the rear panel when in unfolded positions. Rear cabinet doors are hinged to the rearward vertical edges of the foldable side panels. A flat rectangular rear shelf of given length and width dimensions is horizontally hinged along one longitudinal edge to the rear surface of the rear panel a distance below the upper edge of the rear panel at least as great as the width of the shelf. Engaging means on the inner sides of the foldable side panels at a level corresponding to the hinge level of the shelf are provided such that when the left and right foldable side panels are swung outwardly from the rear panel into alignment with the left and right rigid side panels, the shelf may be swung downwardly until opposite sides of the shelf engage the engaging means so that the shelf is level and holds the foldable side panels in their unfolded positions to stabilize the folding cabinet portion.

Forward and rear rollers are also provided which become spaced apart to provide a stable rolling support for the cart when the foldable side panels are in their unfolded position.

Additional features of the cart include the provision of a rectangular tray having forward and side lips arranged to overlie the upper edges of the rear panel and the left and right foldable side panels when in unfolded position to thereby provide further stability to the foldable cabinet portion and also serve as a receptacle for further medical supplies.

BRIEF DESCRIPTION OF THE DRAWINGS

A better understanding of this invention as well as further features and advantages thereof will be had by now referring to the accompanying drawings in which.

DETAILED DESCRIPTION OF THE PREFERRED EMBODIMENT

Figure 1:
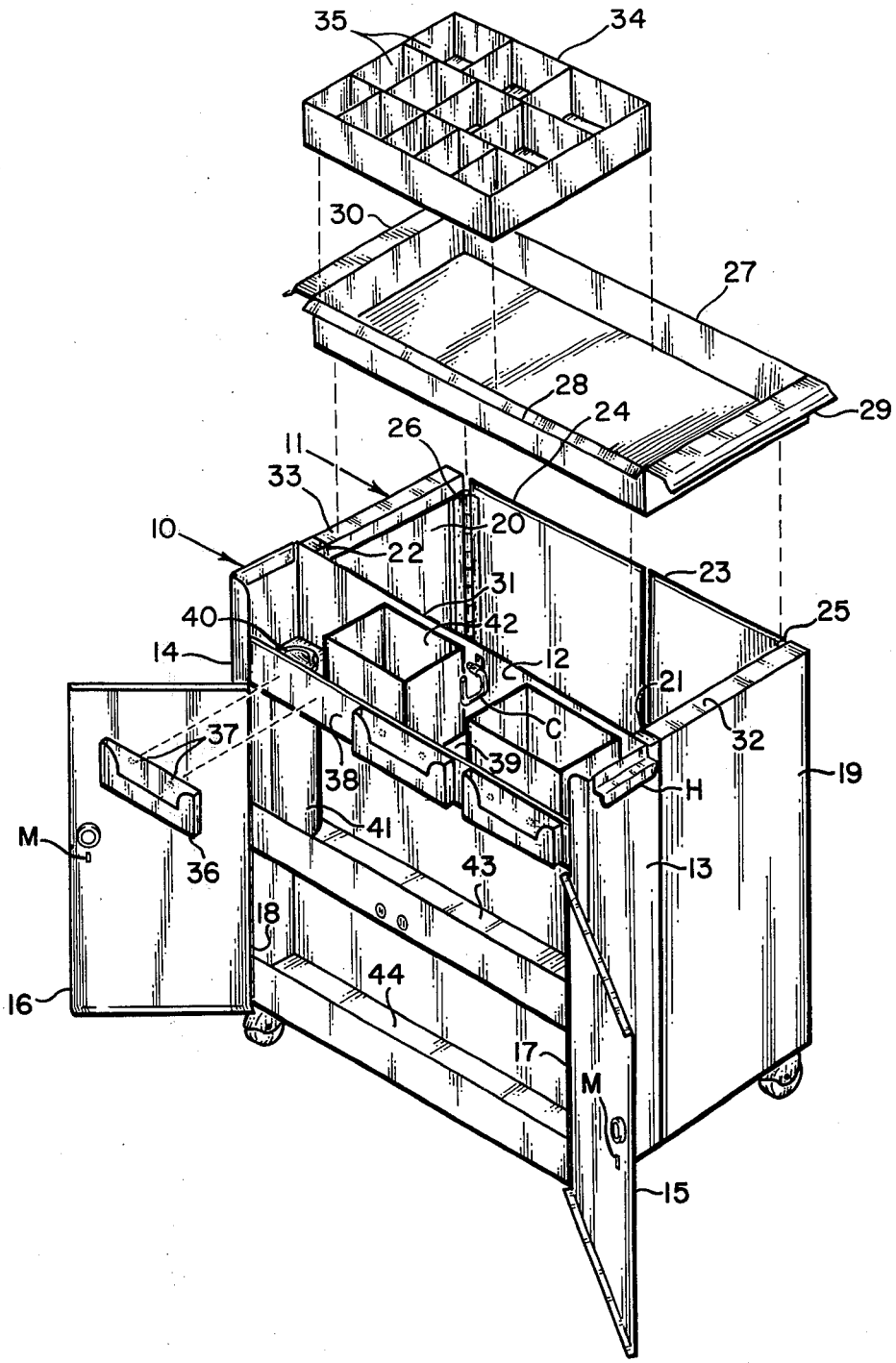
FIG. 1 is a three quarter front exploded perspective view of a preferred embodiment of the cart of this invention in unfolded position.

Referring first to FIG. 1, the blood-specimen procurement cart includes a rigid cabinet portion designated by the arrow 10 and a foldable cabinet portion designated by the arrow 11. The rigid cabinet portion 10 includes a vertical rear panel 12, left and right rigid side panels 13 and 14 secured to and extending forwardly from said rear panel 10, and front cabinet doors 15 and 16 hinged to the forward vertical edges of the rigid side panels as at 17 and 18.

The folding cabinet portion 11 in turn includes left and right foldable side panels 19 and 20 hinged respectively at 21 and 22 to the rear panel 12. These foldable side panels extend rearwardly from the rear panel when in unfolded positions as shown and rear cabinet doors 23 and 24 are in turn hinged as at 25 and 26 to the rearward vertical edges of the foldable side panels.

Shown exploded above the rigid and foldable cabinet portions is a rectangular tray 27 having forward and side lips 28, 29 and 30 arranged to overlie respectively the upper edge 31 of the rear panel 12 and the upper edges of the left and right foldable side panels 32 and 33 when in unfolded position. Since the rectangular tray itself is a rigid structure, it will be appreciated that when positioned over the folding cabinet portion 11, it will provide stability in that it engages and holds the foldable side panels in their unfolded position. Side lips 29 and 30 also serve as push-pull handles and to help in inserting and removing the tray.

Also shown in exploded relationship in FIG. 1 is an insert 34 above the tray 27 defining a series of cubicles 35. This insert made up of the cubicles is receivable in the tray 27 and serves to accommodate various sizes of blood specimen tubes.

It will be noted that the various cubicles 35 are of different sizes and these cubicles are dimensioned such that the smaller cubicle compartments will serve to hold needles, syringes, and various sized specimen tubes. The larger cubicles or compartments in the insert 34 serve as storage for LEE and WHITE blocks and tubes, slide holders, hemogloben vials, and so forth. The remaining space in the tray 27 to the right of the insert 34 as viewed in FIG. 1 may be used to accommodate various separate envelopes for each patient and department.

Referring now to the lower left portion of FIG. 1 there is shown exploded away from the front of the rigid cabinet portion 10 a data card holder 36 having magnet means 37 on a rear surface for holding the data card holder to a front surface of the rigid cabinet portion such as indicated at 38. In this respect, the surface or flange 38 is of metal and preferably the entire cart structure is made of metal panels so that the magnets serve as a convenient means for holding the data card holders in a convenient position. The cards held in the card holder 36 may comprise IBM punch cards associated with various patients. In the particular embodiment illustrated in FIG. 1 there are provided three such card holders, the other two being shown magnetically held to the front surface or flange 38.

The front surface or flange 38 constitutes part of a top front shelf 39 extending between the upper end portions of the left and right rigid side panels 13 and 14 for holding various supplies. As shown, the top shelf 39 includes an opening 40 in its floor communicating with the lower inside of the rigid cabinet portion 10 for receiving a cup dispenser shown at 41. The front surface or flange 38 defines with the floor of the shelf 39 a receiving area which may accommodate open topped rectangular boxes such as the box 42. This box may be used for receiving waste material and can easily be removed from the receiving area for disposing any waste material placed therein.

In the particular embodiment shown in FIG. 1, the interior of the rigid cabinet portion 10 also includes an interior front shelf 43 behind the front cabinet doors when closed extending between the left and right rigid side panels 13 and 14 intermediate the upper and lower ends. This shelf may be used for holding further medical supplies such as culture bottles and the like. A lower front shelf 44 is also provided in the embodiment of FIG. 1 extending between the lower ends of the rigid side panels and this shelf can be used to hold miscellaneous specimen envelopes, supplies, and so forth.

The intermediate and lower internal shelves 43 and 44 both include front flanges of metal similar to the flange 38 for the top shelf 39. Magnet means designated M are provided on the front cabinet doors 15 and 16 in positions to hold the cabinet doors closed against the intermediate shelf front flange surface portion.

Figure 2:
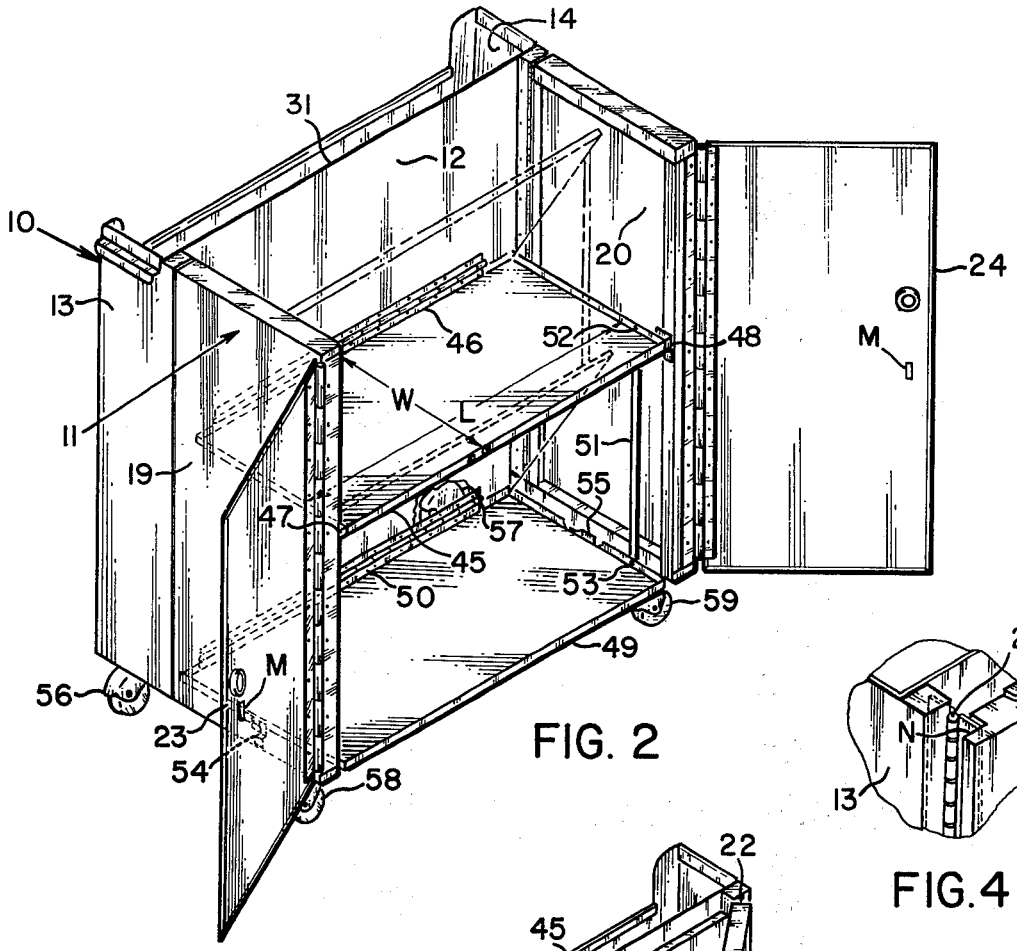
FIG. 2 is a three quarter rear perspective view of the main cart structure in its unfolded position.

Referring now to the rear perspective view of FIG. 2, further important features of this invention will become evident. As shown, the foldable cabinet portion 11 includes a flat rectangular rear shelf 45 of given length and width dimensions indicated by the letters L and W. This shelf is horizontally hinged at 46 along one longitudinal edge to the rear surface of the rear panel 12 a distance below the upper edge 31 of the rear panel at least as great as the width W of the shelf. Engaging means 47 and 48 are provided on the inner sides of the foldable side panels 19 and 20 at a level corresponding to the level of the hinge 46. With this arrangement, it will be evident that the rear shelf 45 may be folded upwardly into flat engagement with the rear panel 12 as indicated in a partially folded condition by the phantom lines. On the other hand, when the shelf 45 is unfolded into a horizontal level position as shown in solid lines wherein the engaging means 47 and 48 are coupled to the far corners of the shelf, the foldable side panels 19 and 20 will be stabilized; that is, held in their unfolded positions as illustrated.

In the preferred embodiment illustrated, there is also provided a lower rear shelf 49 horizontally hinged as at 50 adjacent to the lower edge of the rear panel 12 and of the same dimensions as the first mentioned shelf 45. A simple link means 51 extends from a side of the lower shelf 49 to a corresponding side of the first mentioned shelf 45, the link means being pivoted to the sides of the shelves as indicated at 52 for the first mentioned shelf 45 and 53 for the lower shelf 49. With this arrangement, both shelves are folded upwardly simultaneously to flat engagement with the rear panel 12 when the cart is to be stored.

While not essential, preferably there are provided engaging means 54 and 55 for the lower shelf 49 when in its unfolded horizontal position to thereby couple the lower ends of the foldable side panels 19 and 20 to the lower shelf and thereby lock the lower portions of the foldable sides.

In FIG. 2, the rear cabinet doors 23 and 24 are provided with magnet means M in a position to engage the front edge of the shelf 45 to thereby hold the rear cabinet doors closed.

Referring to the lower portion of the cart shown in FIG. 2, the assembly is completed by the provision of forward left and right rollers 56 and 57, a portion of the rear panel 12 being broken away to expose the right roller. These rollers are secured beneath the rigid cabinet portion 10.

Also provided are rear left and right rollers 58 and 59 secured to the bottom edges of the left and right foldable side panels 19 and 20 adjacent to the hinge points of the rear cabinet doors respectively.

It will be clear that when the folding cabinet portion is unfolded, the left and right rollers are spaced rearwardly of the rear panel to provide rolling stability with the front left and right rollers for both the rigid cabinet portion and foldable cabinet portion. The cart can thus easily be rolled along hospital floors to service patients.

Figure 3:
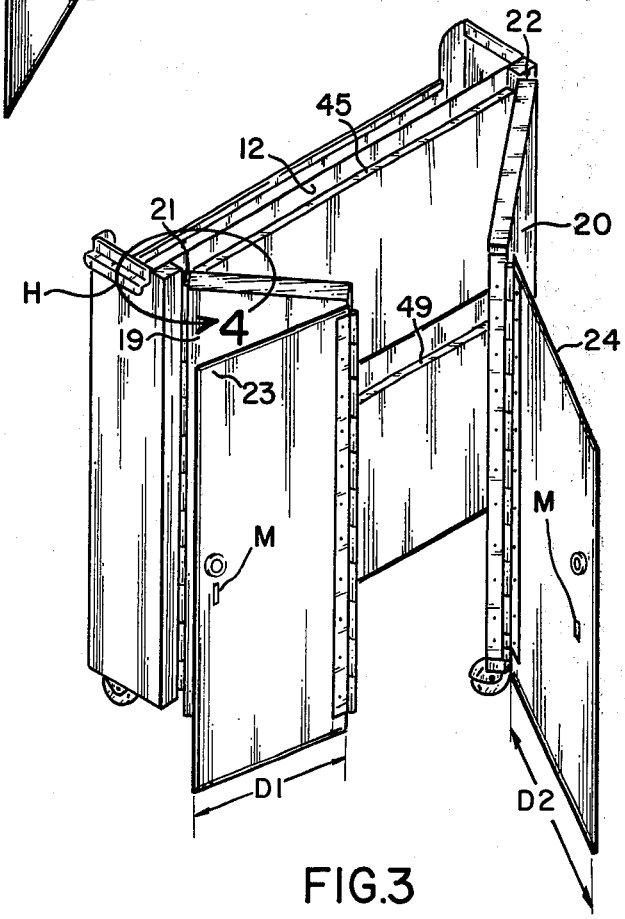
FIG. 3 is a view similar to FIG. 2 but illustrating the positions of various components during the process of folding the cart.

Referring to the partially folded configuration illustrated in FIG. 3, it will be evident that the rear cabinet door 24 is of greater width than the other cabinet door 23, the respective widths being indicated at D2 and D1. By this arrangement, the rear cabinet doors can be folded in the same direction against the foldable side panel when the foldable side panels are folded against the rear panel 12, thereby avoiding any increase in the overall length of the cart when in folded position.

Figure 4:
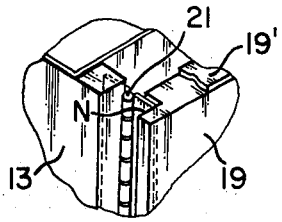
FIG. 4 is a fragmentary perspective view of a hinge portion enclosed in the circular arrow 4 of FIG. 3.

FIG. 4 shows a detail of the hinge 21 wherein the foldable side 19 is provided with a notch N accommodating the hinge pin assembly of the hinge 19 to avoid protrusion of the pin assembly which could interfere with movement of the shelf 45. A finishing top sheet 19′ covers the upper end of the notch so that it is not normally visible. Foldable side 20 and hinge 22 are similarly constructed.

Figure 5:
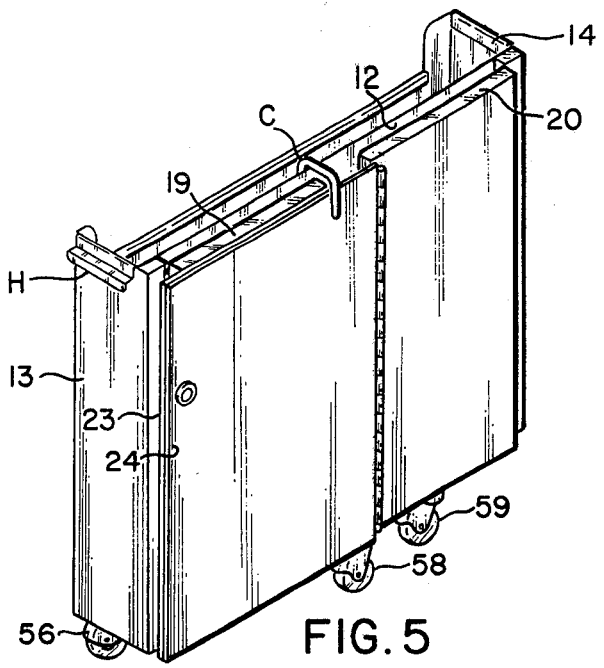
FIG. 5 is a view similar to FIG. 3 but showing the components in completely folded position.

The completely folded position is illustrated in FIG. 5 and it will be noted that there is a small latch C arranged to overlap the upper edge of the rear cabinet door 24 to hold the assembly in its folded condition. The hinging of the latch C to the rear panel 12 is clearly illustrated in FIG. 1.

The various steps to fold the cart will be evident from FIGS. 2, 3 and 5, it being understood that after the tray 27 of FIG. 1 has been removed from the foldable cabinet portion 11, the rear shelves 45 and 49 are folded upwardly into flat engagement with the rear wall 12. The foldable side panels 19 and 20 can then simply be folded inwardly as indicated in FIG. 3 and the rear cabinet doors 23 and 24 folded, as noted, in the same direction to provide the compact configuration of FIG. 5.

Unfolding the cart simply involves a reversal of the foregoing steps.

Figure 6:
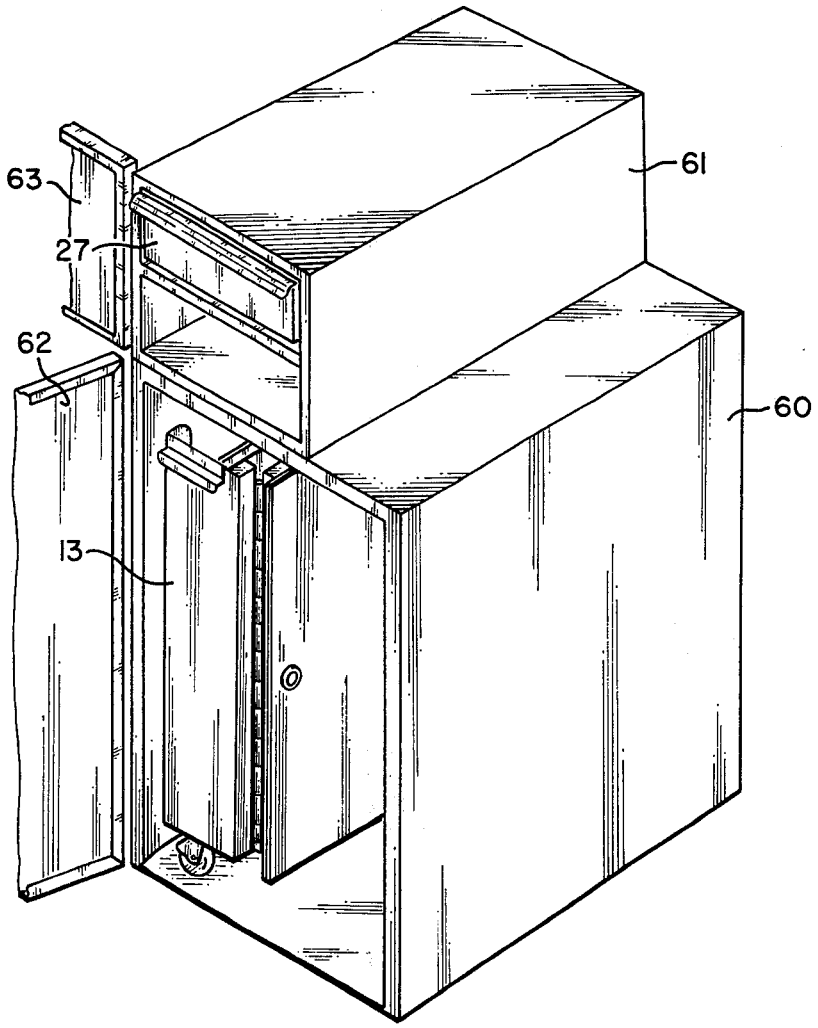
FIG. 6 is a front three quarter perspective view of a suitable housing structure for storing the carts when in folded position.

Referring now to FIG. 6, there is shown a housing 60 having interior dimensions to accommodate two of the carts when in folded position as shown in FIG. 5. In this respect, one of the carts with its left rigid side panel 13 visible is shown within the housing 60 in FIG. 6. Also provided is a smaller housing 61 for accommodating the two trays associated with the carts such as the tray 27. The main housing 60 can be closed as by housing door 62 to provide a compact and neat storage arrangement for pairs of carts. A door 63 also encloses the trays.

From the foregoing description, it will thus be evident that the present invention has provided a greatly improved blood-specimen procurement cart which is stable when in unfolded position and yet may be folded into a compact configuration when not in use. Moreover the arrangement of the tray, shelves, insert cubicles, and front and rear cabinet doors is such as to provide a self-contained unit in which a large number of various types of medical supplies are carried by the cart in a properly organized state.

What is claimed is:

1. A blood-specimen procurement cart for carrying medical supplies comprising, in combination:

a. a rigid cabinet portion including a vertical rear panel, left and right rigid side panels secured to and extending forwardly from said rear panel, and front cabinet doors hinged to the forward vertical edges of the rigid side panels;

b. a folding cabinet portion including left and right foldable side panels hinged to and extending rearwardly from said rear panel when in unfolded positions, and rear cabinet doors hinged to the rearward vertical edges of said foldable side panels;

c. a flat rectangular rear shelf of given length and width dimensions horizontally hinged along one longitudinal edge to the rear surface of said rear panel a distance below the upper edge of said rear panel at least as great as the width of said shelf;

d. engaging means on the inner sides of said foldable side panels at a level corresponding to the hinge level of said shelf;

e. forward left and right rollers secured beneath said rigid cabinet portion; and, f. rear left and right rollers secured to the bottom edges of said left and right foldable side panels adjacent to the hinge points of said rear cabinet doors respectively, whereby when said left and right foldable side panels are swung outwardly from said rear panel into alignment with said left and right rigid side panels, said shelf may be swung downwardly until opposite sides of the shelf engage said engaging means so that said shelf is level and holds the foldable side panels in their unfolded positions to stabilize said folding cabinet portion and whereby said rear left and right rollers are spaced rearwardly of said rear panel to provide rolling stability with said forward left and right rollers for said rigid cabinet portion and foldable cabinet portion so that the resulting cart may be easily rolled along horizontal floors to service patients and when not in use, the left and right foldable side panels can be swung against said rear panel after swinging said shelf upwardly into flat engagement with said rear panel, and the cart easily stored in a compact space.

2. A cart according to claim 1, including a rectangular tray having forward and side lips arranged to overlie the upper edges of said rear panel and said left and right foldable side panels when in unfolded position to thereby provide further stability to said foldable cabinet portion when in unfolded position and also serve as a receptacle for further medical supplies.

3. A cart according to claim 2, including an insert defining a series of cubicles receivable in said tray for accommodating various sizes of blood specimen tubes.

4. A cart according to claim 3, in which said rigid cabinet portion is made of metal and wherein there is provided at least one data card holder having magnet means on a rear surface for holding the data card holder to a front surface of said rigid cabinet portion.

5. A cart according to claim 1, in which said rigid cabinet portion includes a top front shelf extending between the upper end portions of said left and right rigid side panels for holding supplies, said top shelf including an opening communicating with the lower inside of said rigid cabinet portion for receiving a cup dispenser; a front flange on the front edge of said top shelf to define a receiving area; and at least one open topped box receivable in said receiving area for holding waste material.

6. A cart according to claim 1, in which said rigid cabinet portion includes an interior front shelf below said front cabinet doors extending between said left and right rigid side panels intermediate their upper and lower ends for holding additional supplies.

7. A cart according to claim 1, in which there is provided a lower rear shelf horizontally hinged adjacent to the lower edge of said rear panel and of the same dimensions as said first mentioned shelf; and link means extending from a side of said lower shelf to a corresponding side of said first mentioned shelf whereby both shelves are folded upwardly simultaneously into flat engagement with said rear panel when said cart is to be stored.

8. A cart according to claim 1, in which one of said rear cabinet doors is of greater width than the other such that both may be folded in the same direction against the foldable side panels when the foldable side panels are folded against the rear panel to avoid increasing the overall length of said cart when in folded position.

9. A cart according to claim 1, in which said rigid cabinet portion and foldable cabinet portion are made of metal and in which said front cabinet doors and rear cabinet doors have magnet means for holding them in closed positions.

10. A cart according to claim 1, including in combination, a housing dimensioned to accommodate at least two of the carts when in folded side-by-side positions and including a smaller upper housing dimensioned to received two of the flat rectangular trays associated with the cart, the first mentioned housing having front doors which may be closed to provide a compact storage facility for the carts and associated trays.

* * * * *